US005597026A

United States Patent [19]

Fuentes et al.

[11] Patent Number: 5,597,026

[45] Date of Patent: Jan. 28, 1997

[54] VERTICAL BLIND ASSEMBLY

[76] Inventors: Luis C. Fuentes; Niurka E. Gonzalez; Pedro R. Gonzalez, all of 1025 W. 77th St., Unit P, Hialeah, Fla. 33014

[21] Appl. No.: 328,687

[22] Filed: Oct. 25, 1994

[51] Int. Cl.[6] ..... E06B 3/48

[52] U.S. Cl. ..... 160/115; 160/900

[58] Field of Search ..... 160/115, 113, 160/118, 126, 84.09, 900

[56] References Cited

U.S. PATENT DOCUMENTS

| | | | |
|---|---|---|---|
| 2,755,854 | 7/1956 | McIntire | 160/118 X |
| 4,126,172 | 11/1978 | Faragher, Jr. | 160/126 |
| 4,546,809 | 10/1985 | Hadfield | 160/126 |
| 4,628,980 | 12/1986 | Le Houillier | 160/900 X |
| 4,770,224 | 9/1988 | Dubbelman | 160/126 X |
| 4,799,527 | 1/1989 | Villoch et al. | 160/900 X |
| 4,848,435 | 7/1989 | Helver | 160/178.1 V X |
| 5,269,361 | 12/1993 | Ryden et al. | 160/900 X |

FOREIGN PATENT DOCUMENTS

| | | | |
|---|---|---|---|
| 112090 | 10/1965 | Netherlands | 160/84.09 |

*Primary Examiner*—Philip C. Kannan
*Attorney, Agent, or Firm*—Robert M. Downey

[57] ABSTRACT

A vertical blind assembly includes an elongate header casing and two sets of louvers movably supported in adjacent channels within the header casing, including a first set of plain louvers structured to be moved horizontally along the length of the first channel, and a second set of louvers which are molded and configured in a decorative, three-dimensional pattern and structured to be moved horizontally along the length of the second channel so that they are positioned in front of the first set of louvers.

4 Claims, 3 Drawing Sheets

10
20
50
1B
60
21
41
28'
31
28'
40
30
27
27
32
1B 10
60
60
50
50

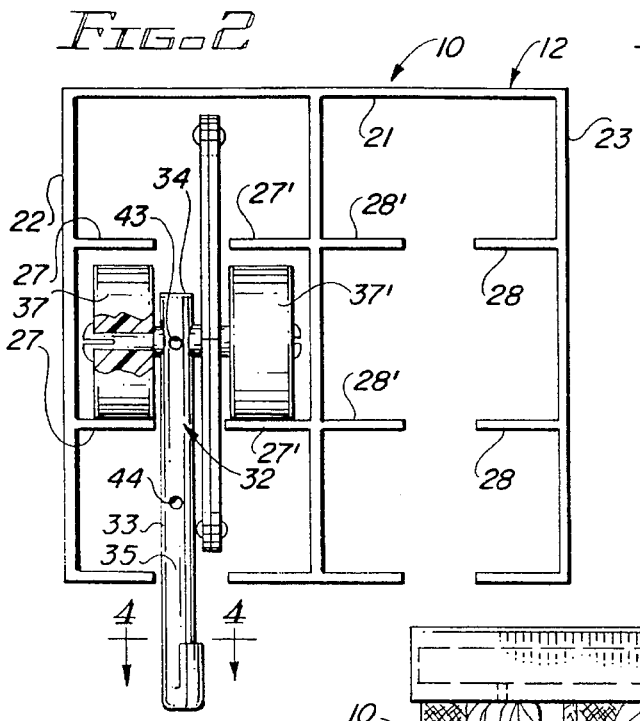
FIG. 2
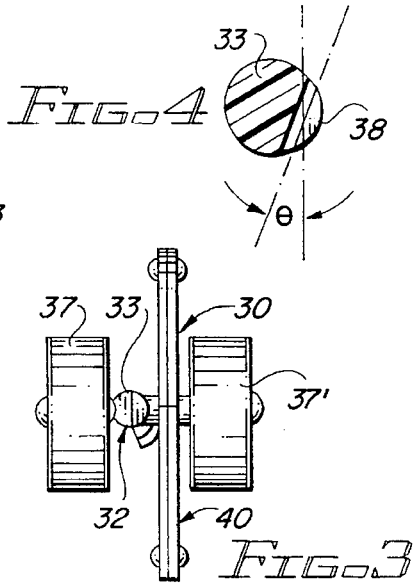
FIG. 4
FIG. 3
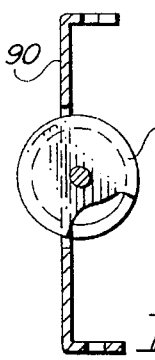
FIG. 5
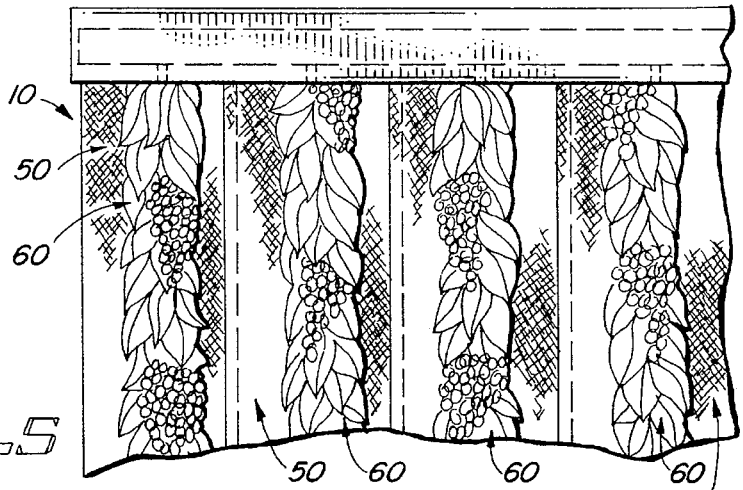
FIG. 7
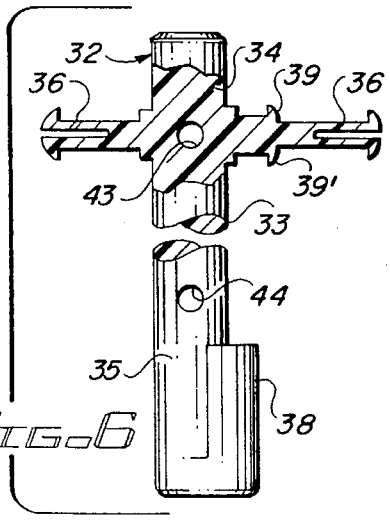
FIG. 6
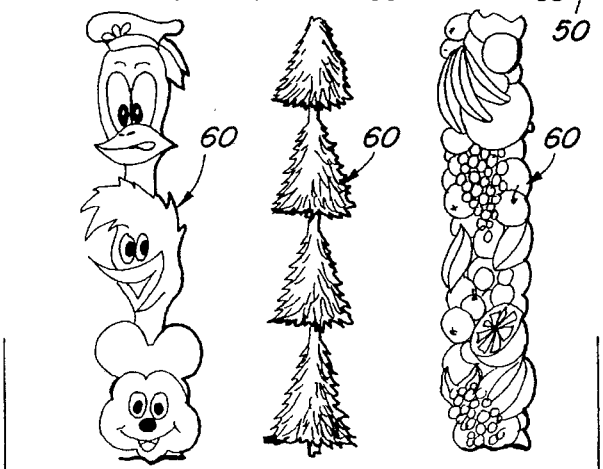
FIG. 8

VERTICAL BLIND ASSEMBLY

BACKGROUND OF THE INVENTION

1. Field of the Invention

The present invention relates to a vertical blind assembly, and more particularly, to a vertical blind assembly having two sets of louvers disposed in spaced, parallel relation, one of which is molded and configured in a decorative pattern.

2. Description of the Related Art

Conventional vertical blind assemblies consist primarily of an elongate header casing, one set of louvers structured to be moved horizontally along the length of the header casing and rotated about their own longitudinal axis, and means for controlling the horizontal and rotational movement of the louvers. A typical example is disclosed by U.S. Pat. No. 4,834,163.

In recent years, modifications to vertical blind assemblies have focused on improving carrier assemblies and tilt control of the louvers. Typical examples are disclosed by U.S. Pat. Nos. 5,067,544, 4,386,644, 4,967,823, 5,056,578, and 5,291,946.

Scissor type extension and retraction means are commonly utilized in vertical blind assemblies to move the louvers horizontally along the header casing. However, the scissor type extension and retraction means used in the prior art have been oriented horizontally within the header casing thereby requiring substantial depth to accommodate the scissor type extension and retraction means within the header casing as shown by U.S. Pat. Nos. 4,848,435 and 5,291,946.

Applicant's invention is designed to provide scissor extension and retraction means oriented in a manner not previously known. Specifically, the scissor type extension and retraction arms facilitating movement of the louvers along the header casing are oriented in a vertical position in the present invention, thereby enabling a second scissor type extension and retraction arm, to control a second set of louvers, to be placed in the header casing without significantly increasing the depth of the header casing.

Applicant's invention is further designed to add a decorative dimension to vertical blind assemblies in a manner not previously known by providing a second set of louvers specifically molded and configured in a decorative pattern, such as a cluster of flowers, fruits, animated characters, etc. The individual louvers in the second set of louvers are spaced apart from one another such that when the first set of louvers is pulled to one side of the window, light is able to pass between the individual louvers in the second set. The second set of louvers is primarily decorative in nature and provides a three-dimensional effect.

SUMMARY OF THE INVENTION

The present invention relates to a vertical blind assembly that includes two sets of parallel louvers, the front set being molded and configured in a decorative pattern. The vertical blind assembly includes primarily an elongate header casing having two parallel channels extending along a length thereof, two sets of louvers, and a traveler assembly movably supported in each channel. Each traveler assembly is structured to vertically support and selectively move one of the sets of louvers horizontally along the length of the respective channel. The first set of louvers are conventional type vertical blinds. The second set of louvers is positioned in front of the first set of louvers, is primarily decorative in nature and provides a three-dimensional effect. Each louver in the second set of louvers is spaced apart from the adjacent louver such that when the first set of louvers is pulled to one side of the window, light is able to pass between the individual louvers in the second set. Further, each louver in both sets of louvers is fixedly angled slightly relative to a longitudinal plane of the header casing and covered window or door so as to facilitate stacking when moved to one side. A scissor linkage is vertically supported within each channel and connected to a plurality of louver carriers such that extension and retraction of the scissor linkage serves to move the plurality of louver carriers along the length of the channels. Each louver carrier is structured for hanging an individual louver thereon. Control means is provided for selectively and individually extending and retracting each scissor linkage within it's respective channel.

With the foregoing in mind, it is an object of the present invention to provide a vertical blind assembly with two adjacent sets of louvers.

It is another object of the present invention to provide a vertical blind assembly wherein the second set of louvers is positioned in front of the first set of louvers and is specifically molded and configured in a decorative pattern.

It is a further object of the present invention to provide a vertical blind assembly with two scissor linkages, each structured such that extension and retraction of the linkages serves to move the respective attached louvers along the length of the header casing.

It is yet another object of the present invention to provide a vertical blind assembly in which the two scissor linkages are vertically supported within the header casing so as to minimize the depth of the header casing required to accommodate the two adjacent scissor linkages and the corresponding two sets of louvers.

It is yet a further object of the present invention to provide a vertical blind assembly with means for independently controlling the horizontal movement of each set of louvers along the length of the header casing so that either the first set of louvers or second set of louvers may be pulled open or closed while the other set remains stationary.

These and other objects and advantages of the present invention will become more readily apparent in the description which follows.

BRIEF DESCRIPTION OF THE DRAWINGS

For a fuller understanding of the nature of the present invention, reference should be had to the following detailed description taken in connection with the accompanying drawings in which:

FIG. 2 is a cross-sectional view, taken along the line 2—2 of FIG. 1 showing the orientation of the first traveler assembly within the left channel of the header casing.

FIG. 3 is a top view of the traveler assembly, taken along the plane of line 3—3 of FIG. 1.

FIG. 4 is a cross-sectional view taken along the line 4—4 of FIG. 2 showing the angular orientation of the louver carrier hook relative to a longitudinal plane of the carrier assembly.

FIG. 5 is a cross-sectional view, taken along the line 5—5 of FIG. 1 showing the end cap with rollers which is attached to one end of the header casing.

FIG. 6 is a front view of the louver carrier taken in partial section.

FIG. 7 is a partial front plan view of the vertical blind assembly.

FIG. 8 is a front view of the second set of louvers illustrating a variety of decorative patterns.

Like reference numerals refer to like parts throughout the several views of the drawings.

DETAILED DESCRIPTION OF THE PREFERRED EMBODIMENT

Figure 1:
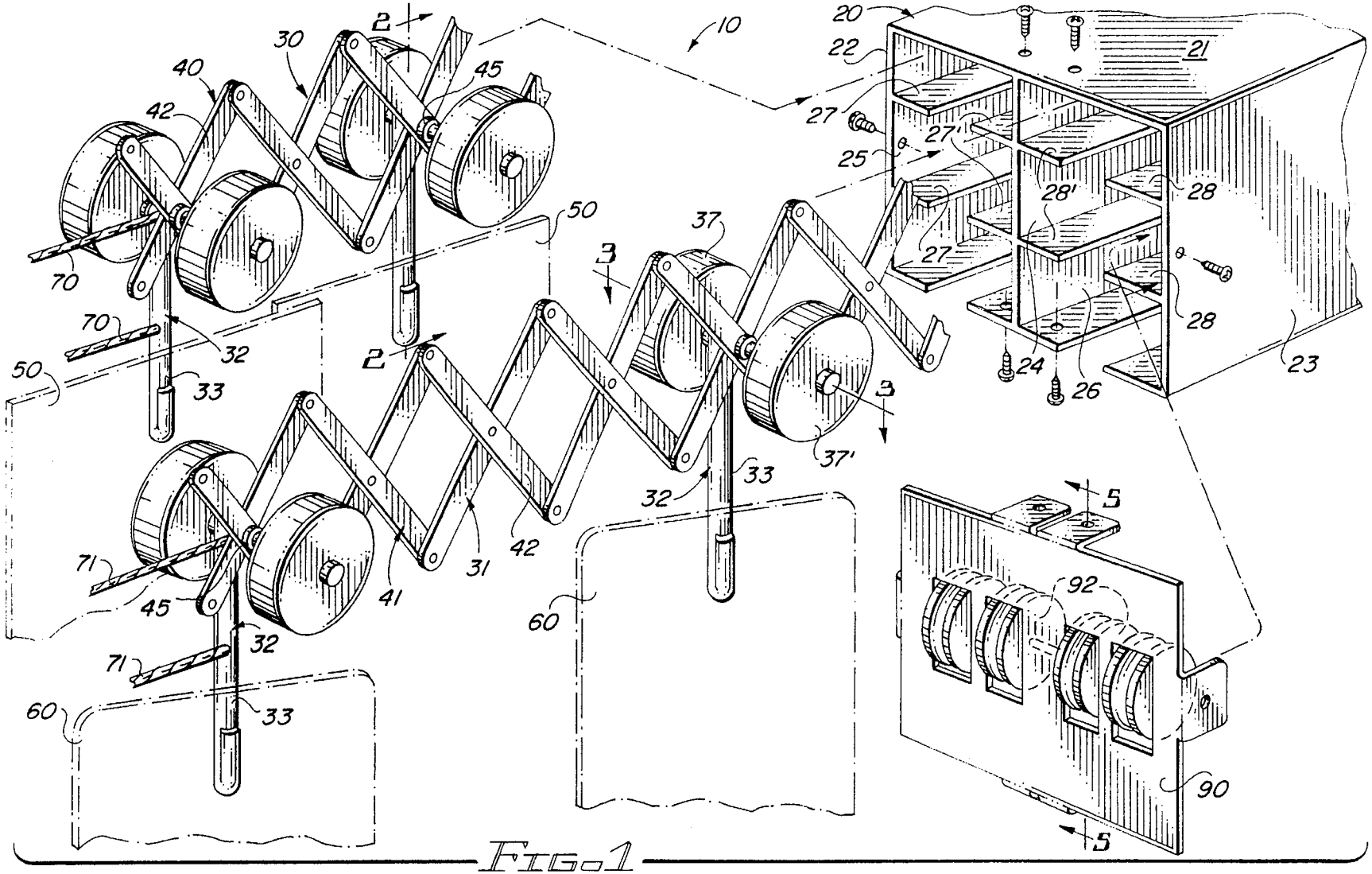
FIG. 1 is an exploded view of the header casing and traveler assemblies taken in partial section.

With reference to FIGS. 1–8, the present invention is directed to a vertical blind assembly, generally indicated as 10, including an elongate header casing 20 having a top wall 21, a first side wall 22, an opposite side wall 23 and a central wall 24 spaced between the first side wall 22 and opposite side wall 23 in parallel relation thereto. A first longitudinal channel 25, defined by the top wall 21, first side wall 22 and central wall 24, and a second longitudinal channel 26, defined by the top wall 21, opposite side wall 23 and central wall 24, extend along the length of the header casing 20. Confrontingly disposed along the first side wall 22 and central wall 24 within the first channel 25 and extending along the length of the header casing 20 is a first pair of inwardly disposed guide rails 27 and 27'. Confrontingly disposed along the opposite side wall 23 and central wall 24 within the second channel 26 and extending along the length of the header casing 20 is a second pair of inwardly disposed guide rails 28 and 28'. The first guide rails 27 and 27' are adapted to slidably hold a first traveler assembly 30 in the first channel 25 and the second guide rails 28 and 28' are adapted to slidably hold a second traveler assembly 31 in the second channel 26.

Figures 1A, 1B:
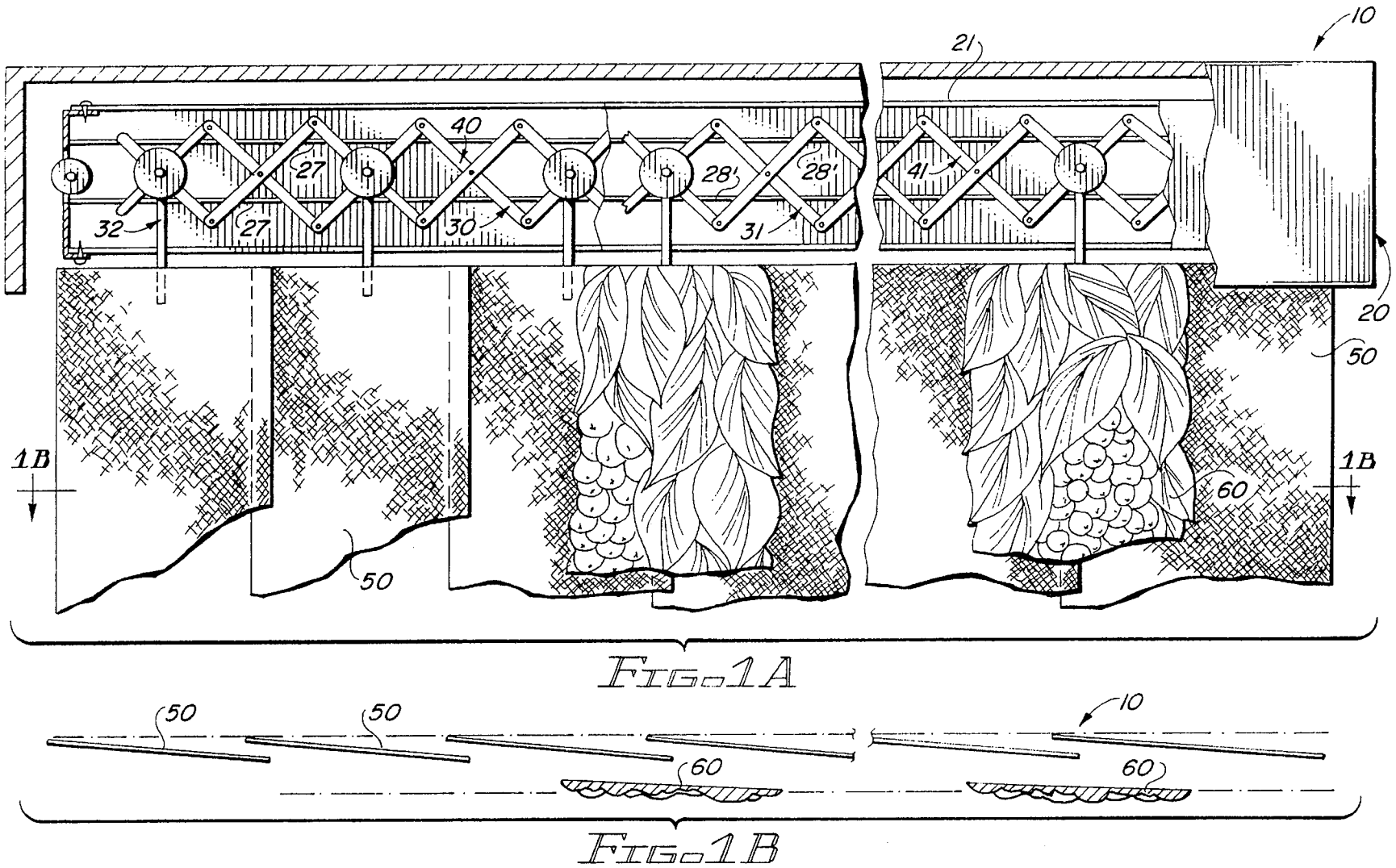
FIG. 1A is a front plan view of the vertical blind assembly of the present invention taken in partial section.
FIG. 1B is a cross-sectional view taken along the line 1B—1B of FIG. 1A illustrating the angular orientation of the second set of louvers.

The first and second traveler assemblies 30 and 31 are structured to vertically support and selectively move a first set of individual louvers 50 and second set of individual louvers 60, respectively, along the length of the header casing 20. The first and second traveler assemblies 30 and 31 each include a plurality of louver carriers 32 and a retracting and extending scissor linkage 40 and 41, respectively. As shown in FIGS. 2–6, each louver carrier 32 includes a stem 33 having an upper end zone 34, a lower end zone 35, a first aperture 43 extending through the upper end zone 34, and a second aperture 44 in parallel relation to the first aperture 43 and extending through the stem 33 between the upper end zone 34 and lower end zone 35, and a transverse axle 36 extending through the upper end zone 34 of the stem 33 in perpendicular relation to the first aperture 43. A pair of wheels 37 and 37' rotatably fitted to opposite ends of the axle 36. The wheels 37, 37' are movably supported on the guide rails 27, 27' and 28, 28' in the first and second channels 25 and 26, respectively. A hook 38 is integrally formed on the lower end zone 35 of the stem 33 and is structured for hanging one of the individual louvers thereon. As shown in FIGS. 1B, 4 and 6, the hook 38 is offset relative to a transverse axis of the axle 36 so as to support the individual louver at a slightly angled orientation relative to a longitudinal plane of the header casing 20, thereby facilitating stacking when moved to one side. As shown in FIG. 6, the transverse axle 36 includes a pair of outwardly disposed tabs 39 and 39' extending from opposite sides of the transverse axle 36. The transverse axle 36 and tabs 39 and 39' are structured and disposed to be inserted through an aperture 45 in the scissor linkage 40 and 41 thereby securing the carriers 32 at spaced intervals along the respective scissor linkages 40, 41. Each scissor linkage 40 and 41 includes a plurality of pivotally interconnected scissor arms 42, each having the aperture 45 centrally located, and sized to prevent reverse passage (removal) of 39 and 39' therethrough once attached° Extension and retraction of the first scissor linkage 40 of the first traveler assembly 30 serves to move the plurality of louver carriers 32 and attached first set of individual louvers 50 along the guide rails 27 and 27' of the first channel 25. Extension and retraction of the scissor linkage 41 of the second traveler assembly 31 serves to move the plurality of louver carriers 32 and attached second set of individual louvers 60 along the guide rails 28 and 28' of the second channel 26.

Control means is provided for selectively and individually extending and retracting the scissor linkages 40 and 41 of the first and second traveler assemblies 30 and 31 along the length of the header casing 20 so that either the first set of individual louvers 50 or second set of individual louvers 60 may be pulled open or closed while the other remains stationary. The control means includes a cord 70, for controlling the first set of louvers 50, extending through the first apertures 43 of all the stems 33 from one end of the header casing to the other, and back through the second aperture 44 of all the stems 33. The cord 70 includes a knot on both sides of the first aperture 43 of the stem 33 of the leading carrier so that the scissor linkage will extend and retract as the cord is pulled in either direction. The control means further includes a second cord 71 for extending and retracting the second set of louvers 60 in the same manner described above. End caps 90 are provided at each end of the header casing 20 and include rollers 92 to accommodate directional, moving passage of the cords 70, 71 therethrough.

As shown in FIGS. 1A, 7 and 8, the second set of individual louvers 60 is specifically molded and configured in a decorative pattern, such as a cluster of flowers, fruit or animated characters providing a three-dimensional effect. Further, each louver in the second set of individual louvers 60 is spaced apart from the adjacent louvers such that when the first set of individual louvers 50 is pulled to one side of the covered window or door, light is able to pass between adjacent louvers in the second set of individual louvers 60. Various changes may be made within the spirit and scope of the invention as described above and set forth in the accompanying claims. The exact angular orientation and spacing of the individual louvers in the second set of louvers may be modified. Further, the decorative pattern and material used may vary.

What is claimed is:

1. A vertical blind assembly comprising:

an elongate header casing including a top wall, a first side wall, an opposite side wall and a central wall spaced between said first side wall and opposite side wall in parallel relation thereto and defining a first channel and an adjacent, parallel second channel, said side walls and said central wall each including a pair of inwardly disposed rails extending perpendicularly therefrom within said first and second channels to form guide rails on opposite sides of each of said first and second channels, said walls and said guide rails extending along a length of said header casing, a first traveler assembly movably supported in said first channel and structured to vertically support and selectively move a first set of individual louvers along the length of said header casing, a second traveler assembly movably supported in said second channel and structured to vertically support and selectively move a second set of individual louvers along the length of said header casing, said first and said second traveler assemblies each including a plurality of louver carriers and a retracting and extending scissor linkage, said louver carriers each including:

a stem having an upper end zone, a lower end zone, a first aperture extending through said upper end zone, and a second aperture in parallel relation to said first aperture and extending through said stem between said upper end zone and said lower end zone, a transverse axle extending through said upper end zone of said stem in perpendicular relation to said first aperture of said stem, said transverse axle including locking means for securing said scissor linkage thereon, a pair of wheels rotatably fitted to opposite ends of said axle and supported on said guide rails in a respective one of said first and second channels, a hook formed on said lower end zone of said stem and structured for hanging one of said individual louvers thereon, said hook being offset relative to a transverse axis of said axle so as to support the individual louver at an angled orientation relative to a longitudinal plane of said header casing, thereby facilitating stacking when said first set of individual louvers or said second set of individual louvers is moved to one side, said scissor linkages each including a plurality of pivotally interconnected scissor arms having an aperture centrally located, said scissor linkage being vertically supported within said respective first and second channels and supportably connected at select pivot points therealong to said axles of said louver carriers, wherein extension and retraction of said scissor linkage serves to move said plurality of louver carriers along said guide rails of said respective first and second channels, said locking means for securing said scissor linkage onto said transverse axle including a pair of outwardly disposed tabs extending from opposite sides of said transverse axle, said tabs being structured to be forcibly inserted through said apertures of said scissor linkage at said select pivot points so that said scissor linkage is supported on said transverse axle between said stem and said tabs, and control means for selectively and individually extending and retracting said scissor linkage of each of said respective first and second traveler assemblies, thereby allowing either said first set of individuals louvers or said second set of individual louvers to be opened or closed while the other remains stationary.

2. A vertical blind assembly as recited in claim 1 wherein said second set of individual louvers is specifically molded and configured in a decorative pattern, thereby providing a three-dimensional effect.

3. A vertical blind assembly as recited in claim 1 wherein said second set of individual louvers are spaced apart from one another such that when said first set of individual louvers is open, light is able to pass between said second set of individual louvers.

4. A vertical blind assembly as recited in claim 1 wherein said control means includes a cord extending through said first apertures of said stems from one end of said header casing to the other and back through said second apertures of said stems, said cord including a knot on both sides of said first aperture of said stem furthest from the end of said header casing where said respective first and second sets of individual louvers stack when pulled to one side so that said scissor linkage will extend and retract as said cord is pulled in either direction.

* * * * *